US008181508B2

(12) United States Patent
Cinpinski et al.

(10) Patent No.: US 8,181,508 B2
(45) Date of Patent: May 22, 2012

(54) DIAGNOSTIC SYSTEMS AND METHODS FOR A TWO-STEP VALVE LIFT MECHANISM

(75) Inventors: Kenneth J. Cinpinski, Ray, MI (US); Donovan L. Dibble, Utica, MI (US); Joshua D Cowgill, Hartland, MI (US); Scot A. Douglas, Howell, MI (US)

(73) Assignee: GM Global Technology Operations LLC

( * ) Notice: Subject to any disclaimer, the term of this patent is extended or adjusted under 35 U.S.C. 154(b) by 424 days.

(21) Appl. No.: 12/557,066

(22) Filed: Sep. 10, 2009

(65) Prior Publication Data

US 2011/0056448 A1 Mar. 10, 2011

(51) Int. Cl.
*G01M 15/09* (2006.01)

(52) U.S. Cl. ..... 73/114.79

(58) Field of Classification Search ..... 73/114.16, 73/114.17, 114.18, 114.77, 114.79
See application file for complete search history.

(56) References Cited

U.S. PATENT DOCUMENTS

| | | | | |
|---|---|---|---|---|
| 7,246,583 | B2 * | 7/2007 | Cinpinski et al. | 123/90.27 |
| 7,921,710 | B2 * | 4/2011 | Cinpinski et al. | 73/114.79 |
| 2005/0126524 | A1 * | 6/2005 | Funke et al. | 123/90.15 |
| 2007/0068474 | A1 * | 3/2007 | Cinpinski et al. | 123/90.17 |
| 2010/0281966 | A1 * | 11/2010 | Cinpinski et al. | 73/114.25 |

OTHER PUBLICATIONS

U.S. Appl. No. 11/943,884, filed Nov. 21, 2007, Donovan L. Dibble.
U.S. Appl. No. 12/062,920, filed Apr. 4, 2008, Allen B. Rayl.

* cited by examiner

*Primary Examiner* — Eric S McCall

(57) ABSTRACT

A system includes a pressure signal adjustment module that generates a maximum pressure signal based on a fluid pressure signal from a pressure sensor of a camshaft phaser system of an engine. The pressure signal adjustment module detects a maximum peak value of the fluid pressure signal and maintains the maximum pressure signal at the maximum peak value for a peak and hold period. A diagnostic module detects a fault of the camshaft phaser system based on the maximum pressure signal during the peak and hold period.

20 Claims, 6 Drawing Sheets

DIAGNOSTIC SYSTEMS AND METHODS FOR A TWO-STEP VALVE LIFT MECHANISM

FIELD

The present disclosure relates to vehicle control systems, and more particularly to diagnostic systems for a two-step valve lift mechanism.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A vehicle includes an internal combustion engine that generates drive torque. The internal combustion engine combusts an air/fuel mixture within cylinders to drive pistons that produce the drive torque. The air/fuel mixture is regulated via intake and exhaust valves. The intake valves are selectively opened to draw air into the cylinders. The air is mixed with fuel to form the air/fuel mixture. The exhaust valves are selectively opened to allow exhaust gas to exit from the cylinders after combustion of the air/fuel mixture.

A rotating camshaft of the engine regulates opening and closing of the intake and exhaust valves. The camshaft includes cam lobes that each has a profile, which is associated with a valve lift schedule. The valve lift schedule includes an amount of time a valve is open (i.e. duration) and a magnitude or degree to which the valve opens (i.e. lift).

Variable valve actuation (VVA) technology improves fuel economy, engine efficiency, and/or performance by modifying a valve lift event, timing, and duration as a function of engine operating conditions. Two-step VVA systems include variable valve assemblies such as hydraulically controlled switchable roller finger followers (SRFFs). SRFFs enable two discrete valve states (e.g. a low-lift state and a high-lift state) on the intake and/or exhaust valves. Example descriptions of the operation of SRFFs are provided in U.S. application Ser. No. 12/062,920, filed on Apr. 4, 2008, and U.S. application Ser. No. 11/943,884, filed on Nov. 21, 2007.

A control module transitions a SRFF mechanism from a low-lift state to a high-lift state and vice versa based on demanded engine speed and load. For example, an internal combustion engine operating at an elevated engine speed, such as 4,000 revolutions per minute (RPM), typically requires the SRFF mechanism to operate in a high-lift state to avoid potential hardware damage to the internal combustion engine.

SUMMARY

Accordingly, a system includes a pressure signal adjustment module that generates a maximum pressure signal based on a fluid pressure signal from a pressure sensor of a camshaft phaser system of an engine. The pressure signal adjustment module detects a maximum peak value of the fluid pressure signal and maintains the maximum pressure signal at the maximum peak value for a peak and hold period. A diagnostic module detects a fault of the camshaft phaser system based on the maximum pressure signal during the peak and hold period.

In other features, a method of diagnosing a two-step valve lift mechanism is provided. The method includes generating a maximum pressure signal based on a fluid pressure signal from a pressure sensor of a camshaft phaser system of an engine. A maximum peak value of the fluid pressure signal is detected. The maximum pressure signal is maintained at the maximum peak value for a peak and hold period. A fault of the camshaft phaser system is detected based on the maximum pressure signal during the peak and hold period.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
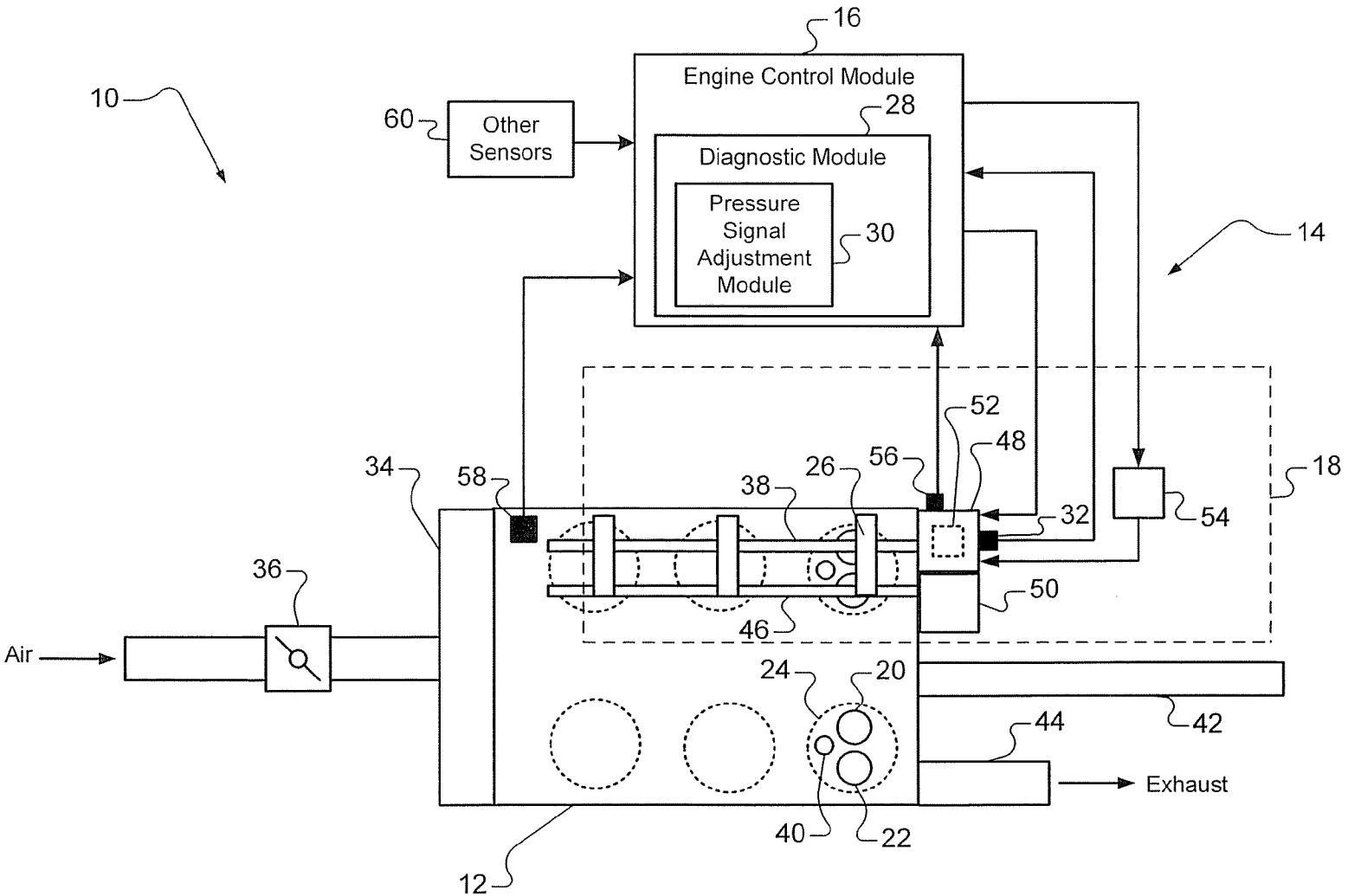
FIG. 1 is a functional block diagram of an exemplary engine control system in accordance with an embodiment of the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module may refer to, be part of, or include an Application Specific Integrated Circuit (ASIC), an electronic circuit, a processor (shared, dedicated, or group) and/or memory (shared, dedicated, or group) that execute one or more software or firmware programs, a combinational logic circuit, and/or other suitable components that provide the described functionality.

An internal combustion engine may operate in a dual overhead camshaft configuration. The dual overhead camshaft configuration may include an exhaust camshaft and an intake camshaft for each bank of cylinders. The exhaust camshaft and the intake camshaft respectively actuate exhaust valves and intake valves of the engine. The intake valves open and close at a specific time to deliver an air/fuel mixture into the cylinders. The exhaust valves also open and close at a specific time to release exhaust gas from the cylinders. Timing of valve events affects airflow, trapped residuals, and spark advance sensitivity. A control system may adjust the timings in each cylinder via a VVA system.

The VVA system may include two or more step valve lift mechanism. For example, a two-step VVA system may include variable valve lift mechanisms that may be used to switch states of intake valves between high-lift and low-lift states. The lift states have corresponding lift profiles. During the high-lift state, an intake valve is lifted to a high level to allow for a predetermined volume of air to enter the corresponding cylinder. During the low-lift state, the intake valve is lifted to a low level, which allows a smaller predetermined volume of air to enter the corresponding cylinder relative to the high-lift state. Current two-step approaches tend to exhibit inconsistent and non-uniform lift transitions and produce inconsistent end results. The inconsistency can be due to a fault with one of the variable valve lift mechanisms.

Engines equipped with a VVA system require accurate fault detection of a variable valve lift mechanism to maintain consistent and desired engine performance. The embodiments of the present disclosure provide techniques for diagnosing a variable valve lift mechanism during engine operation. The diagnostic techniques improve engine efficiency and reduce risks of degradation to engine components.

In FIG. 1, an exemplary engine control system 10 of a vehicle is shown. The engine control system 10 may include an engine 12 and a diagnostic system 14. The diagnostic system 14 may include an engine control module 16 with a camshaft phaser system 18. The camshaft phaser system 18 controls opening and closing of an intake valve 20 and an exhaust valve 22 of a cylinder 24 via a SRFF mechanism 26. The engine control module 16 includes a diagnostic module 28. The diagnostic module 28 detects a fault of the SRFF mechanism 26 based on a maximum pressure signal transmitted from a pressure signal adjustment module 30.

Figure 2:
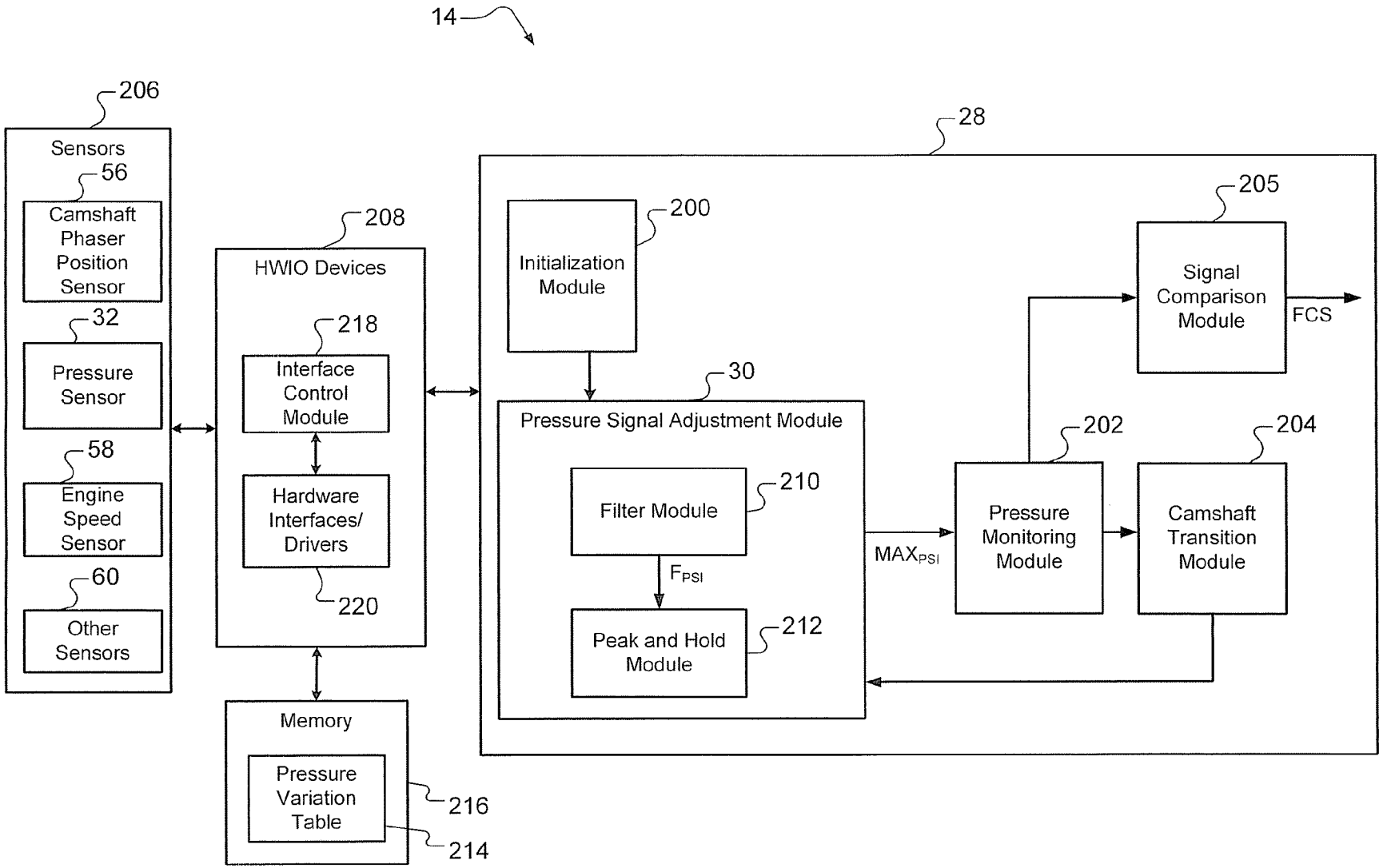
FIG. 2 is a functional block diagram of a diagnostic system for a two-step valve lift mechanism in accordance with an embodiment of the present disclosure.
Figure 3:
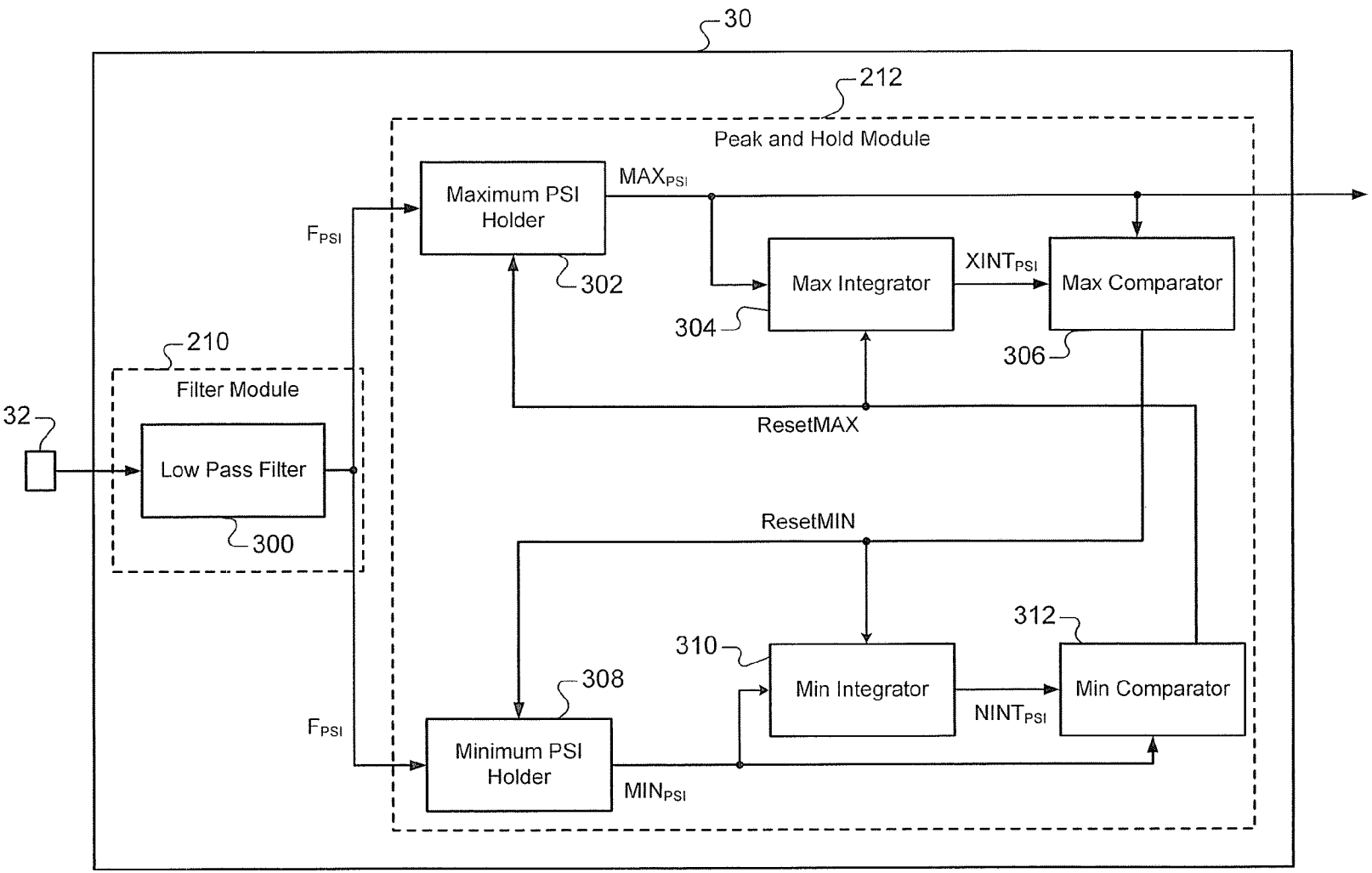
FIG. 3 is a functional block diagram of a pressure signal adjustment module in accordance with an embodiment of the present disclosure.

The maximum pressure signal is generated by the pressure signal adjustment module 30 based on a fluid pressure signal from a pressure sensor 32 of the camshaft phaser system 18. The pressure sensor 32 generates a fluid pressure signal from within the hydraulic cam phaser that is indicative of the SRFF lift state. The diagnostic module 28 identifies one or more of the cylinders 24 associated with faulty SRFF mechanisms 26 and commands remedial actions (e.g. limiting engine speed) to prevent damages to the engine 12. Examples of the diagnostic module 28 and the pressure signal adjustment module 30 are shown in FIGS. 2-4.

During engine operation, air is drawn into an intake manifold 34 through a throttle 36. The throttle 36 regulates mass air flow into the intake manifold 34. The air within the intake manifold 34 is distributed into cylinders 24. Although FIG. 1 depicts six cylinders, the engine 12 may include any number of cylinders 24. The engine 12 may have an inline-type cylinder configuration. While a gasoline powered internal combustion engine is shown, the embodiments disclosed herein apply to diesel or alternative fuel sourced engines.

A fuel injector (not shown) injects fuel that is combined with the air and drawn into the cylinders 24 through an intake port. The fuel injector is controlled to provide a desired air-to-fuel (A/F) ratio within each cylinder 24. The intake valve 20 selectively opens and closes to enable an air/fuel mixture to enter the cylinder 24. The intake valve position is regulated by an intake camshaft 38. A piston (not shown) compresses the air/fuel mixture within the cylinder 24. A spark plug 40 initiates combustion of the air/fuel mixture, driving the piston in the cylinder 24. The piston drives a crankshaft 42 to produce drive torque. Combustion exhaust within the cylinder 24 is forced out an exhaust port 44. The exhaust valve position is regulated by an exhaust camshaft 46. The exhaust is treated in an exhaust system. Although single intake and exhaust valves 20 and 22 are illustrated, the engine 12 may include multiple intake and exhaust valves 20 and 22 per cylinder 24.

The camshaft phaser system 18 may include an intake camshaft phaser 48 and an exhaust camshaft phaser 50 that respectively regulate the rotational timing of the intake and exhaust camshafts 38 and 46. The timing or phase angle of the respective intake and exhaust camshafts 38 and 46 may be retarded or advanced with respect to each other or with respect to a location of the piston within the cylinder 24 or with respect to a crankshaft position.

The position of the intake and exhaust valves 20 and 22 may be regulated with respect to each other or with respect to a location of the piston within the cylinder 24. By regulating the position of the intake valve 20 and the exhaust valve 22, the quantity of air/fuel mixture ingested into the cylinder 24 is regulated. The intake camshaft phaser 48 may include a phaser actuator 52 that is either electrically or hydraulically actuated. Hydraulically actuated phaser actuators 52, for example, include an electrically-controlled fluid control valve 54 that controls a fluid supply flowing into or out of the phaser actuator 52.

Additionally, low-lift cam lobes (not shown) and high-lift cam lobes (not shown) are mounted to each of the intake and exhaust camshafts 38, 46. The low-lift cam lobes and the high-lift cam lobes rotate with the intake and exhaust camshafts 38, 46, and are in operative contact with a hydraulic lift mechanism such as the SRFF mechanism 26. Distinct SRFF mechanisms may be used on each of the intake and exhaust valves 20 and 22 of each cylinder 24. In the present implementation, each cylinder 24 includes two SRFF mechanisms.

Each SRFF mechanism provides two levels of valve lift for one of the intake and exhaust valves 20 and 22. The two levels of valve lift include a low-lift state and a high-lift state based on the low-lift cam lobes and the high-lift cam lobes respectively. During the low-lift state, a low-lift cam lobe causes the SRFF mechanism to pivot to a position in accordance with the prescribed geometry of the low-lift cam lobe. The SRFF mechanism opens one of the intake and exhaust valves 20 and 22 a first predetermined amount (e.g. 4 mm). Similarly, during the high-lift state, a high-lift cam lobe causes the SRFF mechanism to pivot to a position in accordance with the prescribed geometry of the high-lift cam lobe. The SRFF mechanism opens one of the intake and exhaust valves 20 and 22 a second predetermined amount (e.g. 11 mm) that is greater than the first predetermined amount.

The camshaft phaser system 18 may include a camshaft phaser position sensor 56, an engine speed sensor 58, and other sensors 60. The camshaft phaser position sensor 56 senses, for example, a position of the intake camshaft phaser 48 and generates a camshaft phaser position signal indicative of the position of the intake camshaft phaser 48. The pressure sensor 32 generates a fluid pressure signal that indicates a pressure of the fluid supply provided to the phaser actuator 52 of the intake camshaft phaser 48. One or more pressure sensors 32 may be implemented.

The engine speed sensor 58 is responsive to a rotational speed of the engine 12 and generates an engine speed signal in revolutions per minute (RPM). The other sensors 60 of the engine control system 10 may include an oxygen sensor, an engine coolant temperature sensor, and/or a mass airflow sensor. The fluid control valve 54, the camshaft phaser position sensor 56, and the pressure sensor 32 may also be installed for the exhaust camshaft phaser 50.

In FIG. 2, the diagnostic system 14 for a two-step valve lift mechanism of the camshaft phaser system 18 is shown. The diagnostic module 28 may include an initialization module 200, the pressure signal adjustment module 30 of FIG. 1, a pressure monitoring module 202, a camshaft transition module 204, and a signal comparison module 205.

The initialization module 200 receives signals from sensors 206 via hardware input/output (HWIO) devices 208. The sensors 206 may include the camshaft phaser position sensor 56, the pressure sensor 32, the engine speed sensor 58, and other sensors 60 of FIG. 1. The initialization module 200 generates an initialization signal based on the signals from the sensors 206 and determines whether to enable the pressure signal adjustment module 30 by verifying that various initialization conditions are met. The initialization conditions may include ensuring that the engine speed of the engine 12 is less than a predetermined engine speed threshold (e.g. 2000 RPM) and that the intake and exhaust camshaft phasers 48, 50 remain in a low-lift state for a predetermined period. When the initialization conditions are met, the initialization module 200 generates and transmits the initialization signal to the pressure signal adjustment module 30.

The pressure signal adjustment module 30 may include a filter module 210 and a peak and hold module 212. The pressure signal adjustment module 30 enables the filter module 210 to generate a fluid pressure signal $F_{PSI}$. The fluid pressure signal $F_{PSI}$ may be composed of sine waves that have maximum peaks and minimum peaks. The maximum peak represents a highest point of a wave in a cycle. Conversely, the minimum peak represents a lowest point of a wave in a cycle. A cycle refers to a complete change in which a wave attains at least one maximum value and one minimum value, returning to a final value equal to an initial value of the wave. The maximum and minimum values may not be equal to the initial and final values.

The filter module 210 receives an actual fluid pressure signal from the pressure sensor 32 via the HWIO devices 208. The filter module 210 generates the fluid pressure signal $F_{PSI}$ by selectively filtering out noise and/or frequencies of the actual fluid pressure signal that are greater than a predetermined cutoff frequency. The filter module 210 transmits the fluid pressure signal $F_{PSI}$ to the peak and hold module 212.

The peak and hold module 212 scans the fluid pressure signal $F_{PSI}$ for the maximum and minimum peak values over a predetermined diagnostic period (e.g. 8 revolutions or 3.125 milliseconds). The peak and hold module 212 generates a maximum pressure signal $MAX_{PSI}$ based on the maximum peak values of the fluid pressure signal $F_{PSI}$. For example, the peak and hold module 212 detects a maximum peak value of the fluid pressure signal $F_{PSI}$ and maintains the maximum pressure signal $MAX_{PSI}$ at the maximum peak value for a peak and hold period. The maximum pressure signal $MAX_{PSI}$ follows the fluid pressure signal $F_{PSI}$ except during peak and hold periods. The peak and hold period may be determined by the peak and hold module 212 based on slopes of the maximum pressure signal $MAX_{PSI}$. The peak and hold period may begin at a maximum peak of the fluid pressure signal $F_{PSI}$ and end at a minimum peak of the fluid pressure signal $F_{PSI}$. The peak and hold period may be reset to zero based on detection of the minimum peak of the fluid pressure signal $F_{PSI}$. The peak and hold module 212 transmits the maximum pressure signal $MAX_{PSI}$ to the pressure monitoring module 202.

The pressure monitoring module 202 monitors pressure variations that correspond to the cylinders 24 based on the maximum pressure signal $MAX_{PSI}$. The pressure monitoring module 202 receives the maximum pressure signal $MAX_{PSI}$ generated by the peak and hold module 212 during the low-lift state. The pressure monitoring module 202 samples the maximum pressure signal $MAX_{PSI}$ to obtain an average value of maximum peak values corresponding to a cylinder 24. The pressure monitoring module 202 selectively stores the average value associated with each cylinder 24 in a pressure variation table 214 stored in memory 216. A first set of the average values corresponding to the cylinders 24 is saved in the memory 216 for a comparison with a second set generated during a high-lift state.

The camshaft transition module 204 may command each of the SRFF mechanisms to transition to the high-lift state when the storing of the first set of the average values is completed. The camshaft transition module 204 may signal the pressure signal adjustment module 30 to generate the maximum pressure signal $MAX_{PSI}$ associated with the cylinders 24 during the high-lift state after a predetermined wait period. This ensures that the engine 12 has properly transitioned to the high-lift state.

The pressure monitoring module 202 receives the maximum pressure signal $MAX_{PSI}$ generated by the peak and hold module 212 during the high-lift state. The pressure monitoring module 202 iteratively samples the maximum pressure signal $MAX_{PSI}$ to obtain the second set of the average values during the high-lift state. The pressure monitoring module 202 stores the second set of the average values in the pressure variation table 214 to compare with the first set generated during the low-lift state. The pressure monitoring module 202 signals the signal comparison module 205 to calculate differences between the first set of the average values and the second set of the average values corresponding to the cylinders 24.

The signal comparison module 205 determines whether one or more of the SRFF mechanisms 26 associated with the cylinders 24 are faulty based on the pressure differences. The signal comparison module 205 selectively compares the pressure differences associated with each of the cylinders 24 to a predetermined pressure threshold. For example only, the predetermined pressure threshold may be approximately 2.5 pounds per square inch (PSI). The signal comparison module 205 may generate and transmit a fault control signal FCS when the pressure difference is less than the predetermined pressure threshold. The fault control signal FCS indicates that one or more of the SRFF mechanisms 26 are malfunctioning. The signal comparison module 205 may identify one or more of the corresponding cylinders 24 and command a remedial action to prevent degradation of engine components based on the fault control signal FCS.

The HWIO devices 208 may include an interface control module 218 and hardware interfaces/drivers 220. The interface control module 218 may provide an interface between the modules 200, 30, and the hardware interfaces/drivers 220. The hardware interfaces/drivers 220 control operation of, for example, the camshaft phaser position sensor 56, the pressure sensor 32, the engine speed sensor 58, and other engine system devices. The other engine system devices may include ignition coils, spark plugs, throttle valves, solenoids, etc. The hardware interface/drivers 220 also receive sensor signals, which are communicated to the respective control modules. The sensor signals may include the fluid pressure signal, the camshaft phaser position signal, and the engine speed signal.

In FIG. 3, an exemplary embodiment of the pressure signal adjustment module 30 is shown. The pressure signal adjustment module 30 includes the filter module 210 and the peak and hold module 212. The filter module 210 may include a low-pass filter 300. The low-pass filter 300 receives an actual fluid pressure signal from the pressure sensor 32 via the hardware input/output (HWIO) devices 208. The low-pass filter 300 generates the fluid pressure signal $F_{PSI}$ based on the actual fluid pressure signal. The low-pass filter 300 eliminates and/or reduces amplitude of high frequency signals above a predetermined cutoff frequency to minimize electrical noise in the fluid pressure signal $F_{PSI}$. The fluid pressure signal $F_{PSI}$ is transmitted to the peak and hold module 212.

The peak and hold module 212 may include a maximum PSI holder 302, a maximum integrator 304, a maximum comparator 306, a minimum PSI holder 308, a minimum integrator 310, and a minimum comparator 312. The maximum PSI holder 302 converts the fluid pressure signal $F_{PSI}$ into the maximum pressure signal $MAX_{PSI}$ by holding maximum peak values of the fluid pressure signal $F_{PSI}$. The maximum integrator 304 generates a maximum integrated signal $XINT_{PSI}$ based on the maximum pressure signal $MAX_{PSI}$. The maximum comparator 306 compares the maximum pressure signal $MAX_{PSI}$ with the maximum integrated signal $XINT_{PSI}$. The maximum integrator 304 and the maximum comparator 306 are used to reset the minimum PSI holder 308 and the minimum integrator 310.

Similarly, the minimum PSI holder 308 converts the fluid pressure signal $F_{PSI}$ into the minimum pressure signal $MIN_{PSI}$ by holding minimum peak values of the fluid pressure signal $F_{PSI}$. The minimum integrator 310 generates a minimum integrated signal $NINT_{PSI}$ based on the minimum pressure signal $MIN_{PSI}$. The minimum comparator 312 compares the minimum pressure signal $MIN_{PSI}$ with the minimum integrated signal $NINT_{PSI}$. The minimum integrator 310 and the minimum comparator 312 are used to reset the maximum PSI holder 302 and the maximum integrator 304.

The pressure signal adjustment module 30 may be implemented as an analog and/or a digital circuit. The pressure signal adjustment module 30 may also be software based. Moreover, although the maximum pressure signal $MAX_{PSI}$ may be sampled to determine a fault of a SRFF mechanism 26, the minimum pressure signal $MIN_{PSI}$ may also be used in detecting the fault of the SRFF mechanism 26.

Figure 4A:
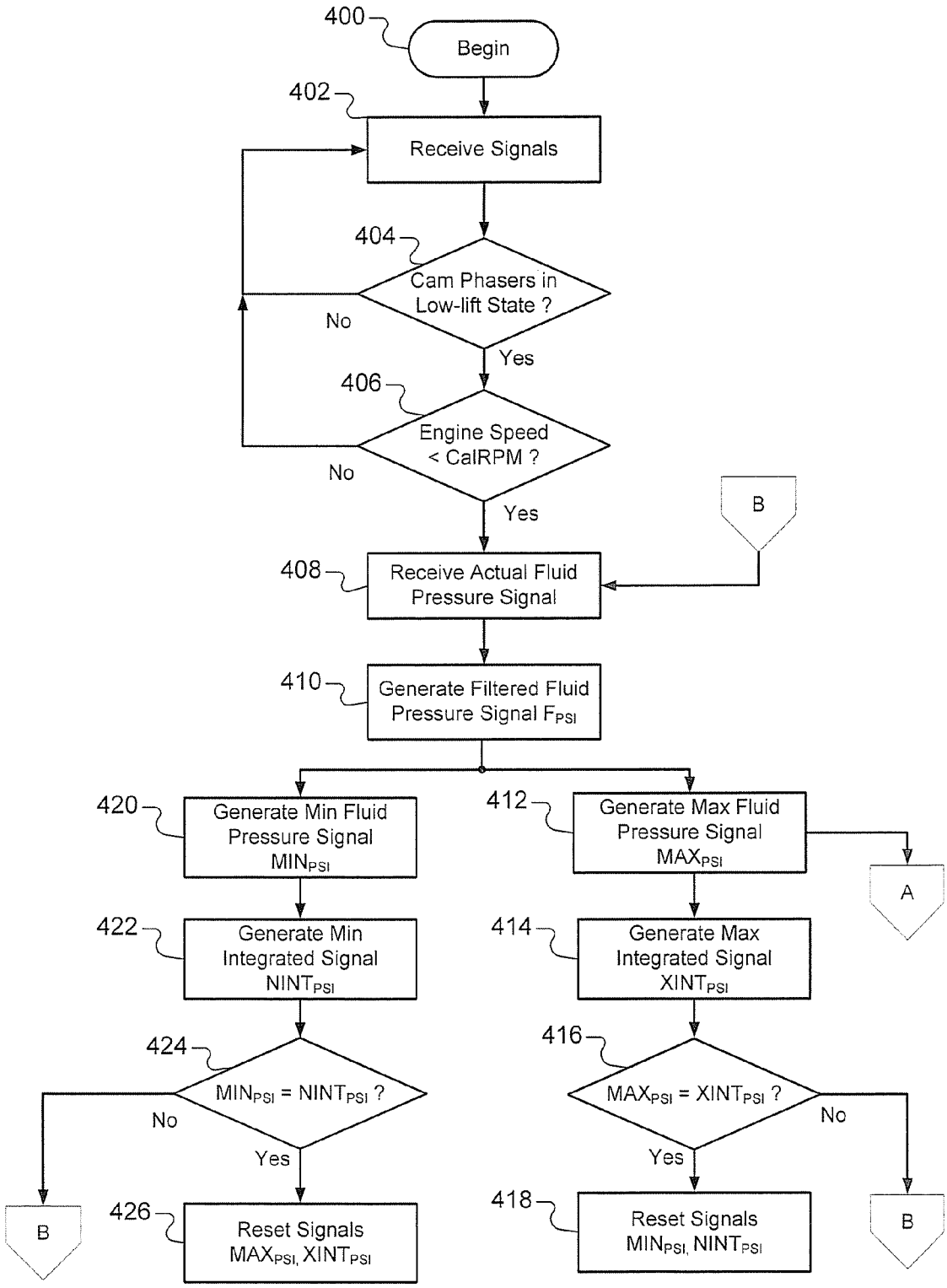
FIGS. 4A and 4B illustrate a method of diagnosing a two-step valve lift mechanism in accordance with an embodiment of the present disclosure.
Figure 4B:
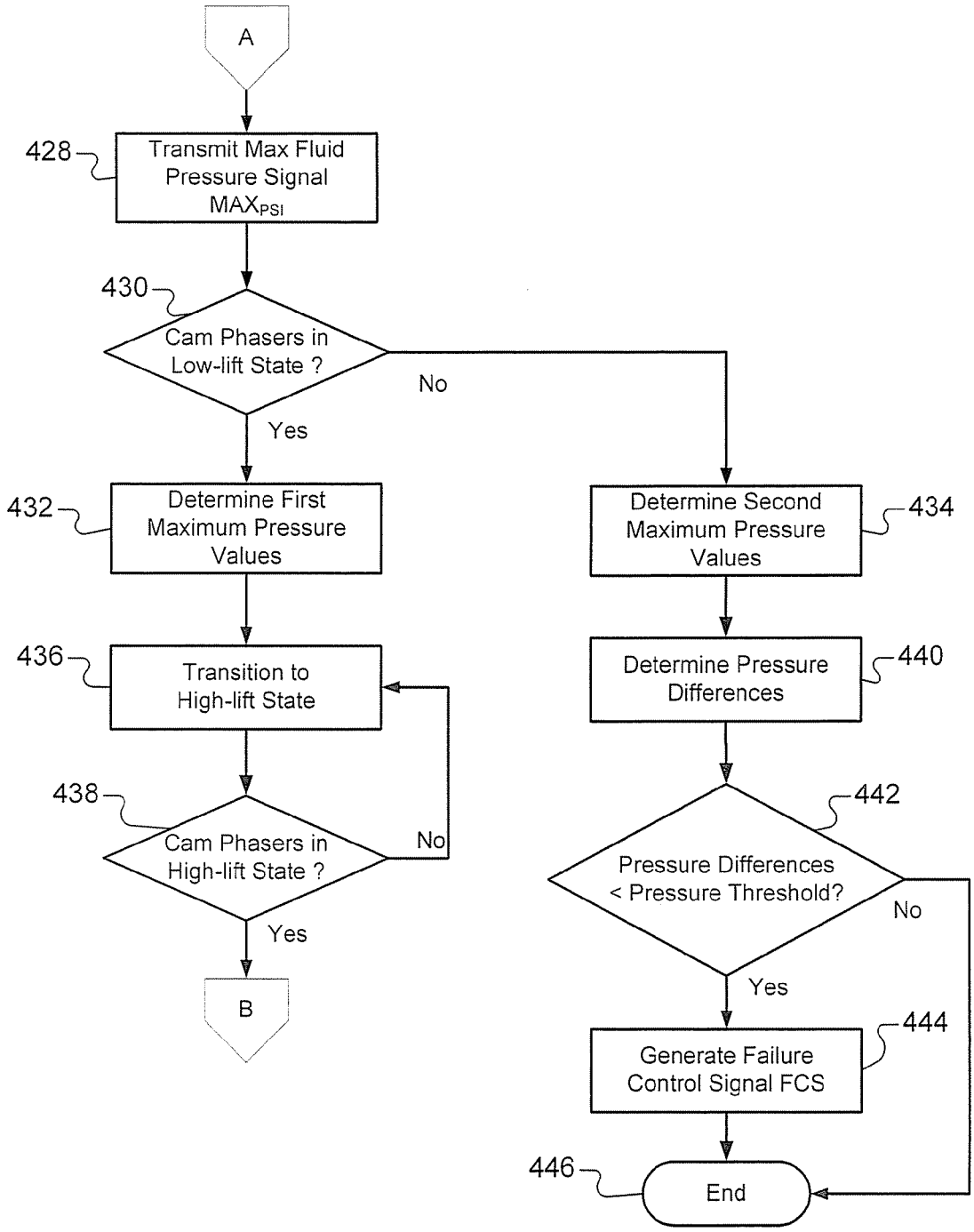

In FIGS. 4A and 4B, an exemplary method of diagnosing a two-step valve lift mechanism is shown. Although the following steps are primarily described with respect to the embodiments of FIGS. 1-3, the steps may be modified to apply to other embodiments of the present invention.

The method may begin at step 400. In step 402, signals from the sensors 206 may be received. The signals may include a camshaft phaser position signal, a fluid pressure signal, and an engine speed signal. The initialization module 200 receives the signals via the HWIO devices 208.

In step 404, when the camshaft phaser position signal indicates that the intake camshaft phaser 48 and the exhaust camshaft phaser 50 are in a low-lift state for a predetermined period, control may proceed to step 406. Otherwise, control may return to step 402. In step 406, when the engine speed signal is less than a predetermined RPM (e.g. CalRPM is 2,000 RPM), control may proceed to step 408. Otherwise, control may return to step 402.

In step 408, the filter module 210 receives an actual fluid pressure signal from the pressure sensor 32 via the HWIO devices 208. In step 410, the initialization module 200 enables the pressure signal adjustment module 30 to generate a fluid pressure signal $F_{PSI}$. The filter module 210 generates the fluid pressure signal $F_{PSI}$ based on the actual fluid pressure signal. The filter module 210 filters out frequencies that are greater than a predetermined cutoff frequency. The filter module 210 provides a signal that may be sampled without noise. The filter module 210 transmits the fluid pressure signal $F_{PSI}$ to the peak and hold module 212.

The fluid pressure signal $F_{PSI}$ associated with a camshaft phaser may be sinusoidal. A sinusoidal waveform of the fluid pressure signal $F_{PSI}$ limits a window of time in which to detect peak pressure values. Due to the shape of a sinusoidal waveform, a peak for a given cycle occurs at a specific time. For this reason, it can be difficult to detect peaks of a pressure signal. Also, depending on the sampling rate used and timing of samples taken relative to peaks of a pressure signal, peak detection values may vary for a single peak and between peaks of the pressure signal.

In step 412, the maximum PSI holder 302 generates a maximum pressure signal $MAX_{PSI}$ based on the fluid pressure signal $F_{PSI}$. The maximum pressure signal $MAX_{PSI}$ provides an increased window of time during which a sampling operation may be performed to detect the peak values during the high-lift and low-lift states. The maximum pressure signal $MAX_{PSI}$ represents a fluid pressure that is supplied to one of the SRFF mechanisms 26 corresponding to a cylinder 24 during the low-lift state. For example, the maximum PSI holder 302 may generate a maximum pressure signal $MAX_{PSI}$ that includes consecutive maximum peaks that correspond to cylinder of an engine. Each maximum peak may be based on timing of valves, spark, and/or fuel controlled by the engine control module 16. The maximum PSI holder 302 transmits the maximum pressure signal $MAX_{PSI}$ to the maximum integrator 304 and the maximum comparator 306.

Figure 5:
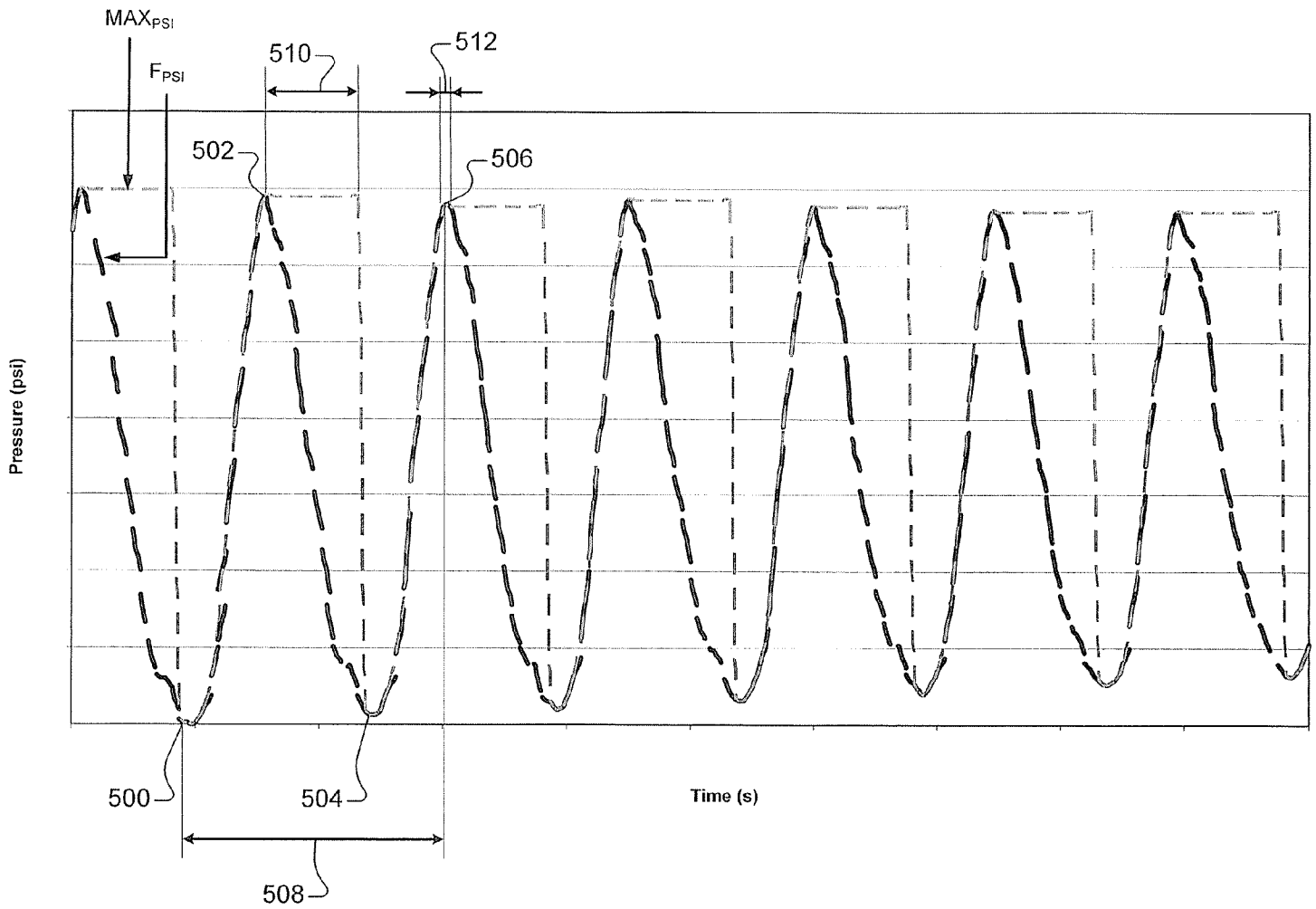
FIG. 5 is an exemplary plot of a fluid pressure signal and a maximum pressure signal in accordance with the embodiment of FIG. 2.

Referring now also to FIG. 5, examples of the fluid pressure signal $F_{PSI}$ and the maximum pressure signal $MAX_{PSI}$ are shown. The maximum pressure signal $MAX_{PSI}$ follows or is the same as the fluid pressure signal $F_{PSI}$ between consecutive minimum peaks and maximum peaks of the fluid pressure signal $F_{PSI}$ and is not the same between consecutive maximum peaks and minimum peaks. For example, the maximum pressure signal $MAX_{PSI}$ is the same as the fluid pressure signal $F_{PSI}$ from a first minimum peak 500 to a first maximum peak 502. The maximum pressure signal $MAX_{PSI}$ may be the same as the fluid pressure signal $F_{PSI}$ while the fluid pressure signal $F_{PSI}$ is increasing. The maximum pressure signal $MAX_{PSI}$ is maintained at the first maximum peak 502 until a second minimum peak 504 of the fluid pressure signal $F_{PSI}$ is detected. The maximum pressure signal $MAX_{PSI}$ is maintained at the maximum peak values of the fluid pressure signal $F_{PSI}$ while the fluid pressure signal $F_{PSI}$ is decreasing.

Peak and hold periods, such as peak and hold period 510, are provided between consecutive maximum and minimum peaks, such as between the first maximum peak 502 to the second minimum peak 504. The peak and hold periods are provided between minimum peak values of the fluid pressure signal $F_{PSI}$ and subsequent maximum peak values of the fluid pressure signal $F_{PSI}$.

This conversion from the fluid pressure signal $F_{PSI}$ to the maximum pressure signal $MAX_{PSI}$ is a result of the capturing and maintaining of signal peaks of the fluid pressure signal $F_{PSI}$ during the peak and hold periods. A peak and hold period refers to a window during which the maximum pressure signal $MAX_{PSI}$ is maintained at a maximum peak value of the fluid pressure signal $F_{PSI}$.

In step 414, the maximum integrator 304 generates a maximum integrated signal $XINT_{PSI}$ based on the maximum pressure signal $MAX_{PSI}$. The maximum integrator 304 integrates the maximum pressure signal $MAX_{PSI}$ to obtain the maximum integrated signal $XINT_{PSI}$. The maximum integrator 304 transmits the maximum integrated signal $XINT_{PSI}$ to the maximum comparator 306. In step 416, the maximum comparator 306 compares the maximum integrated signal $XINT_{PSI}$ with the maximum pressure signal $MAX_{PSI}$. When the maximum integrated signal $XINT_{PSI}$ is equal to the maximum pressure signal $MAX_{PSI}$, control may proceed to step 418. Otherwise, control may return to step 408. In step 418, the maximum comparator 306 resets the minimum PSI holder 308 and the minimum integrator 310 to respective predetermined values.

In step 420, the minimum PSI holder 308 generates a minimum pressure signal $MIN_{PSI}$ based on the fluid pressure signal $F_{PSI}$. The minimum fluid pressure signal $MIN_{PSI}$ follows the fluid pressure signal $F_{PSI}$ from maximum peaks to minimum peaks of the fluid pressure signal $F_{PSI}$. For example, the minimum fluid pressure signal $MIN_{PSI}$ is the same as the fluid pressure signal $F_{PSI}$ from the first maximum peak 502 to the second minimum peak 504. The minimum fluid pressure signal $MIN_{PSI}$ is maintained at the second minimum peak 504 until a second maximum peak 506 of the fluid pressure signal $F_{PSI}$ is detected. The minimum PSI holder 308 transmits the minimum fluid pressure signal $MIN_{PSI}$ to the minimum integrator 310 and the minimum comparator 312.

In step 422, the minimum integrator 310 generates a minimum integrated signal $NINT_{PSI}$ based on the minimum fluid pressure signal $MIN_{PSI}$. The minimum integrator 310 integrates the minimum fluid pressure signal $MIN_{PSI}$ to obtain the minimum integrated signal $NINT_{PSI}$. The minimum integrator 310 transmits the minimum integrated signal $NINT_{PSI}$ to the minimum comparator 312.

In step 424, the minimum comparator 312 compares the minimum integrated signal $NINT_{PSI}$ with the minimum fluid pressure signal $MIN_{PSI}$. When the minimum integrated signal $NINT_{PSI}$ is equal to the minimum fluid pressure signal $MIN_{PSI}$, control may proceed to step 426. Otherwise, control may return to step 408. In step 426, the minimum comparator 312 resets the maximum PSI holder 302 and the maximum integrator 304 to respective predetermined values.

In step 428, the maximum PSI holder 302 transmits the maximum pressure signal $MAX_{PSI}$ to the pressure monitoring module 202. In step 430, when the camshaft phaser system 18 is in the low-lift state, control may proceed to step 432. Otherwise, control may proceed to 434. In step 432, the pressure monitoring module 202 samples the maximum pressure signal $MAX_{PSI}$ to determine an average value of the sampled peak values corresponding to a cylinder 24. The maximum pressure signal $MAX_{PSI}$ provides a peak sampling range, such as the peak and hold period 510, that is longer than a peak sampling range 512 of the fluid pressure signal $F_{PSI}$. In other words, time in which a maximum peak value may be sampled is increased. This reduces inaccuracy and variability in the sampled peak values.

For example, the pressure monitoring module 202 samples the maximum pressure signal $MAX_{PSI}$ once per peak and hold period to obtain N maximum peak values during the low-lift state. M of N maximum peak values may correspond to a cylinder. The pressure monitoring module 202 selectively stores an average value of the M of N maximum values associated with the cylinder in the pressure variation table 214. M is an integer less than or equal to N and N is an integer greater than 1. A first set of the average values during the low-lift state remains in the memory 216 for a subsequent comparison with a second set of the average values during a high-lift state. A maximum value of the M of N maximum values may be used as an alternative to the average value.

In step 436, the camshaft transition module 204 commands the camshaft phaser system 18 to transition from the low-lift state to the high-lift state to obtain the second set of the average values during the high-lift state. The high-lift state is activated for a predetermined period to ensure that the camshaft phaser system 18 has properly transitioned to the high-lift state. In step 438, when the camshaft phaser system 18 is in the high-lift state, control may proceed to step 408. Otherwise, control may return to step 436.

In step 434, as in the low-lift state, the pressure monitoring module 202 iteratively performs sampling of the maximum pressure signal $MAX_{PSI}$ to determine an average value of the sampled peak values corresponding to the cylinder. The second set of the average values during the high-lift state remains in the memory 216 for the subsequent comparison with the first set of the average values determined during the low-lift state. The pressure monitoring module 202 signals the signal comparison module 205 when the storing of the second set is completed.

In step 440, the signal comparison module 205 compares the first set to the second set. In other words, the signal comparison module 205 calculates pressure differences between the low-lift state and the high-lift state. For example, a pressure difference is determined based on a comparison between a first average value from the first set and a second average value from the second set corresponding to the same cylinder 24.

In step 442, when the pressure difference corresponding to a cylinder 24 is less than a predetermined pressure threshold, control may proceed to step 444. This indicates that the SRFF mechanism 26 is operating in a faulty condition. Otherwise, control may end at step 446. In step 444, the signal comparison module 205 generates a fault control signal FCS that identifies one or more cylinders 24 associated with the faulty SRFF mechanisms. Control may end at step 446.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A system comprising:

a pressure signal adjustment module that generates a maximum pressure signal based on a fluid pressure signal from a pressure sensor of a camshaft phaser system of an engine, wherein the pressure signal adjustment module detects a maximum peak value of the fluid pressure signal and maintains the maximum pressure signal at the maximum peak value for a peak and hold period; and a diagnostic module that detects a fault of the camshaft phaser system based on the maximum pressure signal during the peak and hold period.

2. The system of claim 1, further comprising a pressure monitoring module that detects N maximum values of the maximum pressure signal during a diagnostic event, wherein the pressure monitoring module stores M of N maximum values associated with a cylinder of the engine where M is an integer and N is an integer greater than 1.

3. The system of claim 2, wherein the pressure monitoring module determines a fluid pressure value based on at least one of an average value and a maximum value of the M of N maximum values, and wherein the pressure monitoring module stores the fluid pressure value associated with the cylinder.

4. The system of claim 3, wherein the pressure monitoring module stores a first pressure value based on the fluid pressure value determined when the camshaft phaser system is operating in a first lift state, and wherein the pressure monitoring module stores a second pressure value based on the fluid pressure value determined when the camshaft phaser system is operating in a second lift state.

5. The system of claim 4, further comprising a signal comparison module that determines a difference between the first pressure value and the second pressure value, wherein the signal comparison module generates a fault control signal that indicates the fault of the camshaft phaser system when the difference is less than a predetermined pressure threshold.

6. The system of claim 4, further comprising a camshaft transition module that commands the camshaft phaser system to transition from the first lift state to the second lift state, wherein the camshaft transition module enables the pressure signal adjustment module when the second lift state is activated for a first predetermined period.

7. The system of claim 4, further comprising:

an initialization module that generates an initialization signal based on an engine speed and when the engine is in the first lift state for a second predetermined period;

a filter module that generates the fluid pressure signal based on the initialization signal and an actual fluid pressure signal that indicates an input pressure of a fluid supplied to a camshaft phaser of the camshaft phaser system; and a peak and hold module that detects and holds the maximum peak value based on slopes of the maximum pressure signal, wherein the peak and hold module resets the maximum pressure signal to a predetermined value based on detection of a minimum peak value of the fluid pressure signal.

8. The system of claim 7, wherein the filter module filters out frequencies that are greater than a predetermined cutoff frequency from the actual fluid pressure signal.

9. The system of claim 7, wherein the peak and hold period begins at a maximum peak of the fluid pressure signal and ends at a minimum peak of the fluid pressure signal, wherein the maximum pressure signal is equal to the fluid pressure signal except during the peak and hold period.

10. The system of claim 9, wherein the camshaft phaser system controls activation of a two-step valve lift mechanism that adjusts lift of a valve of the engine, wherein the two-step valve lift mechanism corresponds to one of a plurality of cylinders of the engine, and wherein the fault is associated with the two-step valve lift mechanism.

11. A method of diagnosing a camshaft phaser system comprising:

generating a maximum pressure signal based on a fluid pressure signal from a pressure sensor of the camshaft phaser system of an engine;

detecting a maximum peak value of the fluid pressure signal;

maintaining the maximum pressure signal at the maximum peak value for a peak and hold period; and detecting a fault of the camshaft phaser system based on the maximum pressure signal during the peak and hold period.

12. The method of claim 11, further comprising:

detecting N maximum values of the maximum pressure signal during a diagnostic event; and storing M of N maximum values associated with a cylinder of the engine where M is an integer and N is an integer greater than 1.

13. The method of claim 12, further comprising:

determining a fluid pressure value based on at least one of an average value and a maximum value of the M of N maximum values; and storing the fluid pressure value associated with the cylinder.

14. The method of claim 13, further comprising:

storing a first pressure value based on the fluid pressure value determined when the camshaft phaser system is operating in a first lift state; and storing a second pressure value based on the fluid pressure value determined when the camshaft phaser system is operating in a second lift state.

15. The method of claim 14, further comprising:

determining a difference between the first pressure value and the second pressure value; and generating a fault control signal that indicates the fault of the camshaft phaser system when the difference is less than a predetermined pressure threshold.

16. The method of claim 14, further comprising:

commanding the camshaft phaser system to transition from the first lift state to the second lift state; and enabling a pressure signal adjustment module when the second lift state is activated for a first predetermined period.

17. The method of claim 14, further comprising:

generating an initialization signal based on an engine speed and when the engine is in the first lift state for a second predetermined period;

generating the fluid pressure signal based on the initialization signal and an actual fluid pressure signal that indicates an input pressure of a fluid supplied to a camshaft phaser of the camshaft phaser system;

detecting and holding the maximum peak value based on slopes of the maximum pressure signal; and resetting the maximum pressure signal to a predetermined value based on detection of a minimum peak value of the fluid pressure signal.

18. The method of claim 17, further comprising filtering out frequencies that are greater than a predetermined cutoff frequency from the actual fluid pressure signal.

19. The method of claim 17, further comprising:

beginning the peak and hold period at a maximum peak of the fluid pressure signal and ending the peak and hold period at a minimum peak of the fluid pressure signal; and setting the maximum pressure signal to a value equal to the fluid pressure signal except during the peak and hold period.

20. The method of claim 19, further comprising:

controlling activation of a two-step valve lift mechanism that adjusts lift of a valve of the engine;

corresponding the two-step valve lift mechanism to one of a plurality of cylinders of the engine; and associating the fault with the two-step valve lift mechanism.

* * * * *